US007345957B2

(12) United States Patent
Nirasawa

(10) Patent No.: US 7,345,957 B2
(45) Date of Patent: Mar. 18, 2008

(54) WAVE TIMEPIECE

(75) Inventor: Shoji Nirasawa, Chiba (JP)

(73) Assignee: Seiko Instruments Inc. (JP)

( * ) Notice: Subject to any disclaimer, the term of this patent is extended or adjusted under 35 U.S.C. 154(b) by 61 days.

(21) Appl. No.: 11/341,798

(22) Filed: Jan. 27, 2006

(65) Prior Publication Data

US 2006/0171258 A1 Aug. 3, 2006

(30) Foreign Application Priority Data

Feb. 2, 2005 (JP) ..... 2005-026029
Jan. 16, 2006 (JP) ..... 2006-007708

(51) Int. Cl.
*G04B 1/00* (2006.01)

(52) U.S. Cl. ..... 368/47; 368/88; 368/281

(58) Field of Classification Search ..... 368/47, 368/88, 281
See application file for complete search history.

(56) References Cited

U.S. PATENT DOCUMENTS 6,934,222 B2 * 8/2005 Fujimori ..... 368/204
7,061,439 B1 * 6/2006 Minami et al. ..... 343/718
7,158,449 B2 * 1/2007 Fujimori et al. ..... 368/47
2004/0004909 A1 * 1/2004 Fujimori ..... 368/204
2005/0018543 A1 * 1/2005 Fujisawa ..... 368/47
2006/0012527 A1 * 1/2006 Kai et al. ..... 343/700 MS
2006/0114162 A1 * 6/2006 Minami et al. ..... 343/718

* cited by examiner

*Primary Examiner*—Gary F. Paumen
(74) *Attorney, Agent, or Firm*—Adams & Wilks

(57) ABSTRACT

A wave timepiece has an antenna disposed within or on the side of a case. The antenna has a magnetic core member comprised of magnetic foils that are superposed and stacked one over the other in the radial or transverse direction of the case and laminated together to form a laminated body, and a coil wound around the magnetic core member. Typically, the antenna is disposed in the case between a dial window and a rear cover, and the laminated body of magnetic foils is curved in conformity with the inner circumferential curved face of the case. The wave timepiece exhibits improved reception sensitivity due to the radial or transverse stacking of the magnetic foils.

10 Claims, 3 Drawing Sheets

WAVE TIMEPIECE

BACKGROUND OF THE INVENTION

1. Field of the Invention

The present invention relates to a wave timepiece.

2. Description of the Prior Art

A wave timepiece which receives a standard wave including time information and corrects a display time depending on the time information has been known. It is also suggested to compose a magnetic core member of an antenna provided with a magnetic core member and a coil of a laminated body made by laminating soft magnetic foils in the wave timepiece of the wrist watch. In the wave timepiece of this suggestion, each foil composing the laminated body of the magnetic core member of the antenna has a flat shape and a flat face of each foil is arranged so as to be elongated in parallel with the elongated direction of a rear cover or the like (JP-A-2003-110341).

In addition, the antenna provided with a magnetic core member that is not linear as a whole has been also suggested (Specification of JP 3526874).

According to the wave timepiece disclosed in these technologies, the antenna is arranged in an antenna housing case that is formed at the outside of a timepiece case.

When a user tries to house the antenna in the timepiece case, the reception sensitivity of the antenna tends to be lower because a large metal component is disposed around the antenna.

The present invention has been made taking the foregoing problems into consideration and an object of which is to provide a wave timepiece that can suppress deterioration of reception sensitivity of an antenna provided with a magnetic core and a coil to the minimum.

SUMMARY OF THE INVENTION

In order to attain the above-described object, the wave timepiece of the present invention has an antenna which includes a magnetic core member in which soft magnet foils are laminated in the elongated direction of the main face of the timepiece and a coil winding around this.

In this wave timepiece, since the magnetic core member of the antenna is made of a foil laminated in the direction elongated on the main face of the timepiece, even if the thickness of the timepiece is comparatively thin, the flow channel of an eddy current to cross the foil on the elongated face of the foil is substantially cut off. Therefore, the eddy current loss can be suppressed to the minimum. Here, the main face means a face that is perpendicular to the thickness direction of the timepiece.

In other words, in a receiving antenna in the shape winding the coil around the magnetic core member, it is inevitable that leak of a magnet flux is generated from a part where the coil winds to some extent. This leak of the magnet flux to be generated upon reception of the standard wave is temporarily varied in accordance with temporal variation of the standard wave that is modulated by the time information. It is feared that this leak of the magnet flux that is temporarily varied may generate the eddy current at the unignorable level in the case that there is a metal component around the leak of the magnet flux. In the case that the magnetic core member is made of the laminated body of the foils, the eddy current of a direction crossing the elongated face of the foil (the lamination direction) is substantially inhibited and the eddy current flows along the elongated face of the foil in practice. As a result, if there is a large metal component at a location opposed to the main face of the foil, the flow channel of the eddy current is given in cooperation with the foil, the eddy current is increased, and the eddy current loss is easily increased.

However, in the wave timepiece according to the present invention, the soft magnet foil composing the magnetic core member is laminated in the elongated direction of the main face of the timepiece. Therefore, even if the comparatively large metal component is located in the vicinity to the thickness direction of the timepiece, as long as the wave timepiece lacks the metal component that closes and faces to the foil in the enlargement direction of the main face, this kind of eddy current can be suppressed comparatively low. Accordingly, even if there is the metal component in the thickness direction of the timepiece, it is possible to make the timepiece comparatively thin while suppressing the occurrence of this kind of eddy current at the minimum.

According to the wave timepiece of the present invention, typically, the antenna is housed in a case between a dial window and a rear cover and a plurality of laminated bodies of the foils to compose the magnetic core member is curved in an arc.

According to the wave timepiece of the present invention, even if the dial window and the rear cover of the case are made of metal, not the main face of the foil but the edge of the laminated body faces to these dial window and rear cover. Therefore, as long as a distance from the elongated face (the main face) of the foil to the large metal component is kept comparatively large, this kind of eddy current loss can be suppressed to the minimum and the reception sensitivity of the antenna can be enhanced.

In general, a comparatively thin wrist watch is preferred. Assuming that the soft magnet foil composing the magnetic core member is arranged between the dial window made of metal and the rear cover made of metal within the case with the laminations perpendicular to the main face of the timepiece as disclosed in JP-A-2003-110341, the eddy current generated along the elongated face of the foil of the magnet core member easily flows along the metal component (the dial window and the rear cover) disposed above and below the antenna. As a result, the eddy current loss is increased and it is difficult to ignore the deterioration of the wave reception sensitivity efficiency. On the contrary, according to the wave timepiece of the present invention, this kind of eddy current loss can be suppressed to the minimum.

As a result, according to the wave timepiece of the present invention, it is possible not only to minimize the thickness but also to have an expensive-looking wave timepiece by making the dial window or the like of metal. In addition, it is also possible to house the antenna within the case being sandwiched between the dial window and the rear cover.

However, if it is desired, in place of placing the antenna within the case, the antenna may be located in an antenna housing case that is separately provided at the one side of the case.

In the above description, the magnetic core member may be curved along the case or the like; may be linearly elongated; or may be curved in the shape of a broken line.

BRIEF DESCRIPTION OF THE SEVERAL VIEWS OF THE DRAWINGS

A preferred form of the present invention is illustrated in the accompanying drawings in which:

FIG. 1 illustrate wave timepieces according to a first preferable example of the present invention.

FIG. 2 are views for explaining the antenna of the wave timepiece of FIG. 1, FIG. 3 illustrate wave timepieces according to a second preferable example of the present invention.

DETAILED DESCRIPTION OF THE PREFERRED EMBODIMENTS

Next, the preferable embodiments of the present invention will be described depending on the preferable examples illustrated in the attached drawings.

Figure 1A:
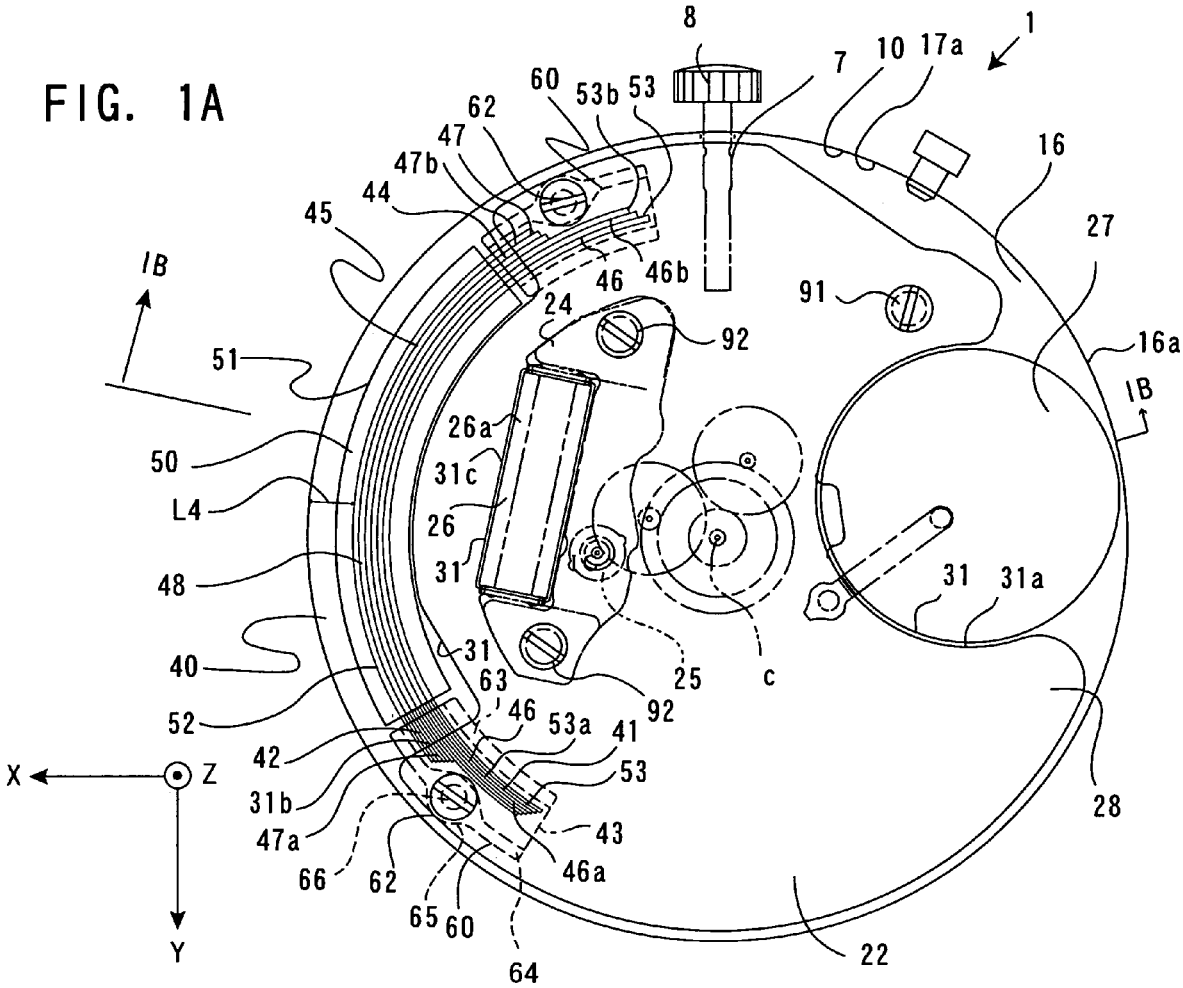
FIG. 1A is a plan explanatory view indicating the inside of a case with a rear cover omitted.
Figure 1B:
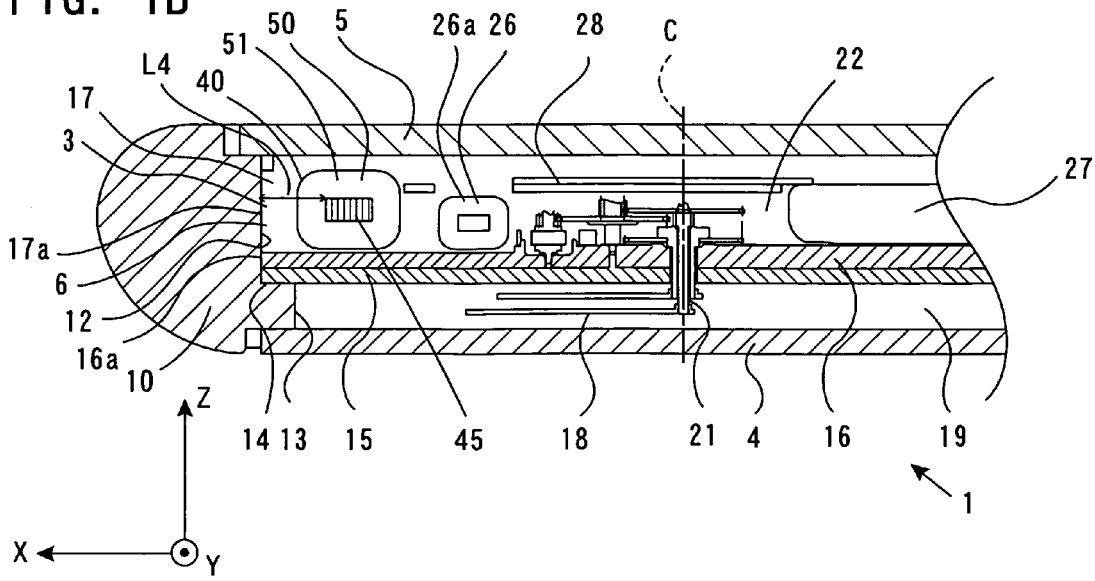
FIG. 1B is a sectional explanatory view taken on a line IB-IB of FIG. 1A.

In FIGS. 1A and 1B, a wave timepiece 1 of a preferable first example according to the present invention is illustrated. The wave timepiece 1 has a case 10 made of a nonmagnetic metal material having an inner circumferential face 11 provided with a flat shape in a circle. An opening part 3 having approximately a cylindrical shape of the case 10 is closed by a glass 4 and a rear cover 5 made of metal at the opposite side of the glass 4 to be made into a container 6 for various timepiece components. A reference numeral 7 denotes a winding stem and a reference numeral 8 denotes a crown.

At a stepped part 14 between a large diameter cylindrical part 12 and a small diameter cylindrical part 13 of the case 10, a dial window 15 made of nonmagnetic metal material and a bottom board 16 made of a resin are mounted so as to define the container 6 of the case 10 into a chamber 17 where various driving components are housed and a chamber 19 where various pointers are housed. For example, the bottom board 16 is provided with an outer circumferential face 16*a* shaped in a circle, which is approximately similar to an inner circumferential face 17*a* of the chamber 17 of the case 10. Here, the main face of the timepiece 1 coincides with the face on which the dial window 15 and the rear cover 5 are elongated and the main face of the timepiece 1 is a face (an X-Y plane) that is parallel with the face shown in FIG. 1A.

Concentric various bodies or shanks 21 pass through the center of the bottom board 16 along a center axis line C. Respective bodies 21 having respective pointers 18 attached to the ends projecting in the chamber 19 are connected with each other by various gears around the bodies 21 in the chamber 17 to make a watch movement 22 as a whole. Many of various gears composing a wheel row of the movement 22 are rotatably supported between the bottom board 16 and wheel row bearings attached to the bottom board 16 at intervals.

In the vicinity of the wheel row of the movement 22 distributed around the center axis line C, a motor 26 including a stator 24 and a rotor 25 is attached to the bottom board 16 by screws 92, and at the opposite side of the stator 24 with respect to the center axis line C, a button type battery 27 is arranged. A reference numeral 26*a* denotes a coil.

In addition, with respect to an elongated direction Z of the center axis line C, a circuit board 28 is mounted at the rear side of the motor 26 to be fixed to the bottom board 16 by a screw 91. In order to allow various large components to be arranged, the circuit board 28 has a cutting part or an opening part 31 in which these various large components can be partially fitted with play. This opening part or the cutting part 31 includes a large hemicycle or approximately circular cutting part 31*a* to allow arrangement of the button type battery 27, an oblong opening part 31*c* to allow arrangement of the stator 24, and further, a large arc cutting part 31*b* to allow arrangement of a receiving antenna 40 to be described later.

At the side facing to the rear cover 5 in the circuit board 28, a circuit component including a crystal controlled oscillator or the like is mounted, and in the same way, a pointer 18 is rotated via the movement 22 by driving the motor 26 supplied with electricity by the battery 27.

In the vicinity of the outer circumferential part of the bottom board 16, the receiving antenna 40 as the antenna structure in the shape of an arc as a whole is fitted and fixed by an antenna frame 60 made of a resin and a screw 62 made of a resin.

The antenna 40 is provided with a magnetic core member 45 comprised of a laminated body of flakes 43 and 44 (each thickness is about 0.4 mm) made by overlapping plural pieces (for example, each 20 pieces or so) of longer foils (for example, a length is about 30 mm) 41 and plural pieces (for example, each 20 pieces or so) of shorter foils (for example, a length is about 20 mm) 42 as a foil made of a soft magnetic amorphous alloy (for example, a width is about 0.8 mm and a thickness is about 20 μm). The longer foils 41 and the shorter foils 42 are superposed and stacked one over another in the radial or transverse direction of the case 10 and overlapped with each other, and the laminated body 45 has a shape curved in an arc so that the flakes 44 made of the shorter foils 42 are located at the outer circumferential side. The shorter flake 44 is disposed in the middle of a longitudinal direction of the longer flake 43, and the opposite ends 46*a* and 46*b* (when they are not distinguished, they are represented by a reference numeral 46) of the longer flake 43 are projected from the opposite ends 47*a* and 47*b* (when they are not distinguished or they are named generically, they are represented by a reference numeral 47) of the shorter flake 44. The thickness, the number of laminations, the width, and the length or the like are herein described as merely an example and it is obvious that each of them may be larger or smaller. Further, although the thicknesses of the flakes 43 and 44 and the number of laminations of the groups of foils 41 and 42 are the same in this example, however, they may be different. From three or more kinds of foils having different lengths, three or more kinds of flakes having different lengths may be formed. In addition, typically, the opposite ends 46*a* and 46*b* at the opposite sides have the same measurements and shapes, however, the shapes and the lengths of the opposite ends 46*a* and 46*b* may be different from each other depending on the layout, other arrangement environment, and the kinds of the adjacent components. Further, the magnetic core member 45 may be made of a lamination body of many foils having substantially the same lengths in place of being made of plural foils having different lengths.

At a center part 48 of the magnetic core member 45, a coil 50 is formed by winding a wire 51 many times via an electrical insulating film.

Figure 2A:
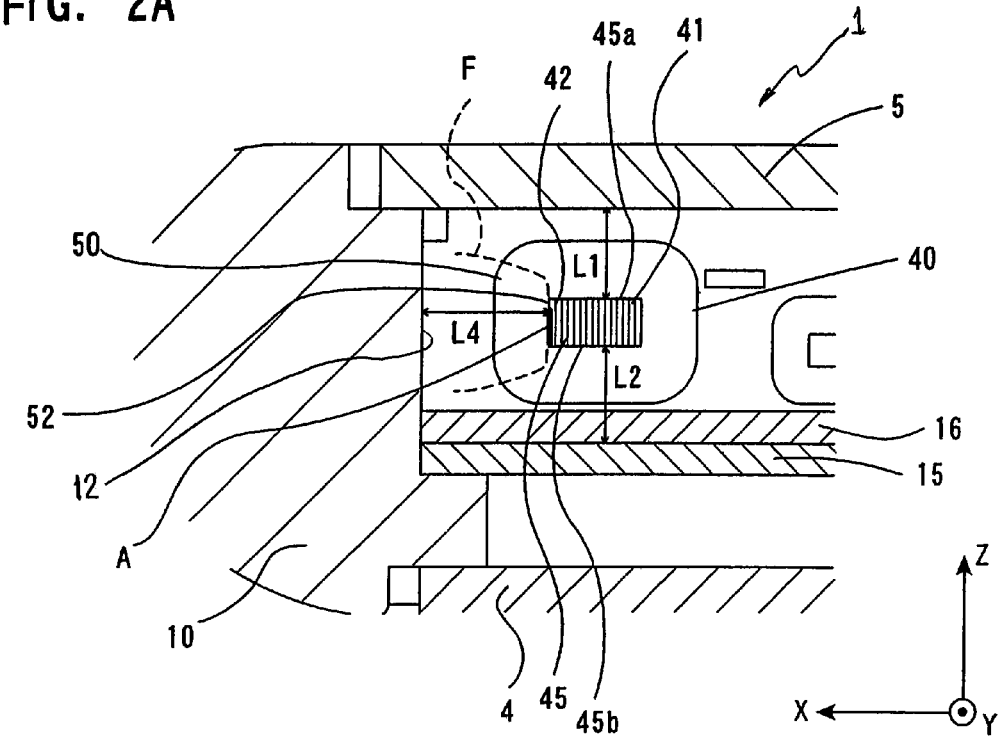
FIG. 2A is the similar sectional explanatory view as FIG. 1B enlarging and illustrating the periphery of the antenna.

The magnetic core member 45 curved in an arc forms an arc centering on the center axis C in practice. Accordingly, as shown in FIGS. 1A, 1B and 2A, a distance or an interval L4 between an outer circumferential face 52 of the flake 44 in the magnetic core member 45 and the inner circumferential face 17*a* of the chamber 17 of the case 10 is substantially fixed over the whole length of the magnetic core member 45. In other words, since the magnetic core member 45 is curved in an arc, the magnetic core member 45 can be arranged within the case 10 close to the circumferential face 17*a* so as to keep a desired interval L4 to the case 10 and minimize the shared space including this interval L4. This interval is about several mm (for example, about 2 mm). However, it may be larger or smaller than this. Further, in any case, this interval L4 tends to be set larger as compared to the interval in the thickness direction of the timepiece 1 or the like.

Exposed ends 53*a* and 53*b* (when they are not distinguished or they are named generically, they are represented by a reference numeral 53) protruded and exposed from the opposite ends of the coil 50 in the magnetic core member 45 of the antenna 40 configure ends for receiving a wave. This end 53 is configured by the end 47 of the above-described shorter flake 44, a part overlapped on the end 47 of the longer flake 43, and the projected part 46.

Each exposed end 53 of the magnetic core member 45 is covered with an antenna frame 60 whose section is shaped in a U-character to form a passage for the projected part 46. As shown in FIG. 1A, the inner circumferential side configuring a U-shaped leg part of the antenna frame 60 and a wall part 64 at the outer circumferential side among the outer circumferential side wall parts 63 and 64 are provided with a thick part 65 that is enlarged with thickness at the front side far from the end 47 of the shorter flake 44 in the exposed end 53 of the magnetic core member 45. On the thick part 65, a screw hole 66 is formed and by the screw 62 inserted into the screw hole 66, the antenna frame 60 is fixed to the bottom board 16. As shown in FIG. 1A, the thick part 65 forms a constriction in the U-shaped passage, and the longer foils 41 extend past the constriction whereas the shorter foils 42 terminate short of the constriction. According to this example, the thick part 65 is also enlarged outwardly in a radial direction to secure a screwed range. Accordingly, the antenna 40 is fixed to the bottom board 16 by the antenna frame 60 while utilizing a narrow space. For example, in the screw 62, a diameter of a head thereof is about 1.5 mm and a diameter of an axial part thereof is about 0.7 mm. However, each diameter may be larger or smaller than this.

Further, in this antenna 40, the exposed end 53 of the magnetic core member 45 lacks the flake 44 at the front end 46 where the magnet flux is easily enlarged, so that the front end 46 of the exposed end 53 can be located far from the inner circumferential face of the case 10. Therefore, due to the existence of the case 10, fear that reception of the wave is blocked is decreased and the reception sensitivity of the wave can be enhanced. In addition, since there is no fear that the front end 46 of the end 53 comes under the influence of the case 10, the wave can be received in a wider range while elongating the front end 46 and the reception sensitivity can be easily enhanced. Therefore, the gap L4 between the antenna 40 and the case 10 can be minimized and a shared space including the gap 14 can be minimized.

In this antenna 40, even if the eddy current to cancel the leak of the magnet flux from the gap of the coil 50 occurs in accordance with the temporal variation of this leak of the magnet flux according to the temporal variation of the magnet flux with the temporal variation of the magnetic field component of the standard wave modulated by the time information, a conductive material giving the flow channel of this eddy current does not exist at a position forming the flow channel in the vicinity of the antenna 40. Therefore, the strong eddy current is hard to generate and this makes it possible to minimize the loss due to this kind of eddy current.

Figure 2B:
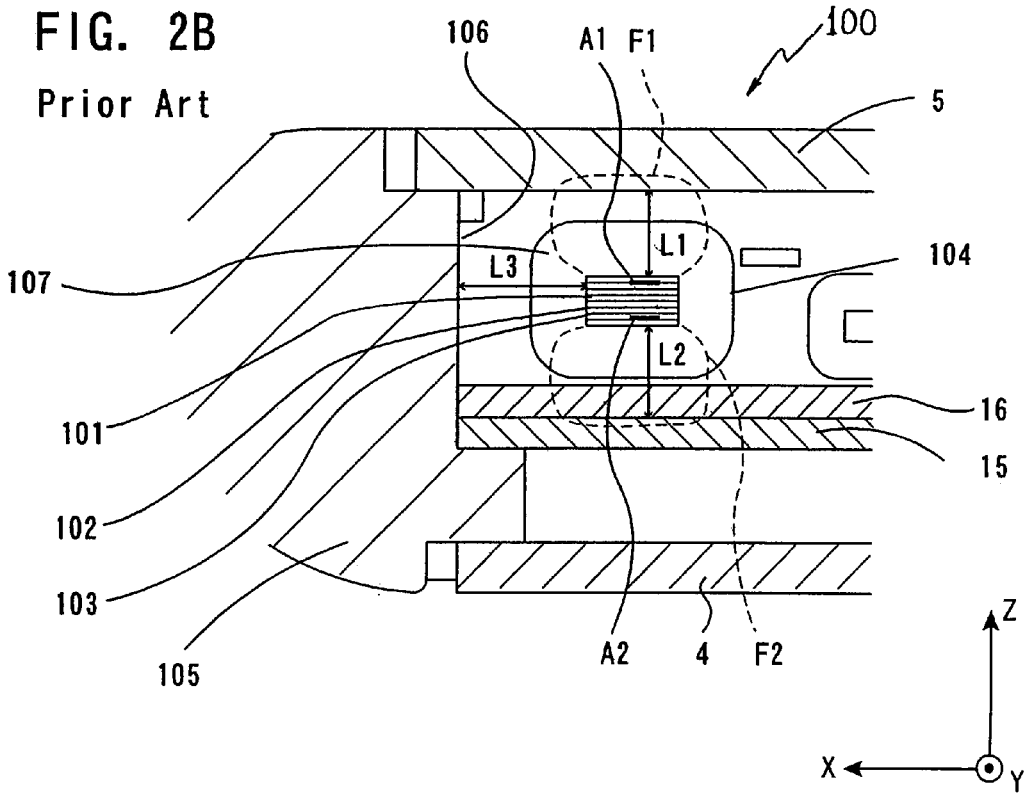
FIG. 2B Prior Art
FIG. 2B is the similar sectional explanatory view to FIG. 1A in the case of the conventional arrangement of the antenna.

In other words, assuming the case that the conventional antenna arrangement is employed within a case 105 of a wrist watch 100, for example, as shown in FIG. 2B, the timepiece has an antenna 104 provided with a magnetic core member 103 made of a lamination body 102 of a foil 101 elongated along the main face of the timepiece, namely, the elongated direction (the X-Y plane) of the dial window 15 and the rear cover 5 in parallel with the dial window 15 and the rear cover 5 between the dial window 15 made of metal and the rear cover 5 made of metal. Here, in the wrist watch 100, as long as the wrist watch 100 is not so thick that it is ill-shaped, the thickness, namely, the length in the Z direction is comparatively small as compared to the enlargement in the X and Y directions, so that it is inevitable that the distance between the magnetic core member 103 and the metal members 5, 15, and 105 is smaller in the Z direction rather than in the X and Y directions. In other words, in the wrist watch 100, a distance L1 between the magnetic core member 103 and the metal rear cover 5 and a distance L2 between the magnetic core member 103 and the metal dial window 15 are shorter than the shortest distance L3 between the magnetic core member 103 and the inner circumferential face 106 in the case 105. In other words, L1, L2<L3. Accordingly, in the case, that leak of the magnet flux that is temporarily varied upon reception of the standard wave is generated and the eddy currents A1 and A2 are generated in the elongated direction of the foil 101, these eddy currents A1 and A2 easily flow along the flow channel including the rear cover 5 made of metal and the dial window 15 made of metal located near and elongated in parallel as shown by reference marks F1 and F2 in FIG. 2B. Therefore, the detection sensitivity due to a coil 107 of the antenna 104 is lowered by the amount that the standard wave is converted into these eddy currents A1 and A2.

On the other hand, in this wave timepiece 1, as shown in FIG. 2A, the foils 41 and 42 of the antenna 40 are superposed and laminated in a transverse direction (X-Y direction) that is transverse to the thickness direction (Z direction) of the case 10, i.e., in the elongated direction of the main face (the X-Y plane) of the timepiece 1, namely, the elongated directions X and Y of the rear cover 5 made of metal and the dial window 15 made of metal to be elongated in the direction Z perpendicular to the elongated directions. Therefore, the distances between edges 45*a* and 45*b* of the laminated body 45 and the corresponding metal components 5 and 15 are smaller than the shortest distance L4 between the outer circumferential face 52 of the laminated body 45 and the inner circumferential face 12 of the case 10. In other words, L1, L2<L4. Accordingly, even if the leak of the magnet flux temporary varies upon reception of the standard wave is generated and the eddy current A is generated in accordance with this on the elongated face of the foil 41, since the distance L4 from the case 10 made of metal is larger as compared to the distances L1 and L2 from the rear cover 5 made of metal and the dial window 15 made of metal (L4>L1, L2), the effective resistance of a flow channel F of this eddy current A becomes large and the large eddy current is hardly generated. Accordingly, a rate that the standard wave is consumed for occurrence of the eddy current A is suppressed to the minimum and the detection sensitivity of the antenna 40 is enhanced.

In the above descriptions, the dial window 15 and the rear cover 5 are made of nonmagnetic metal, however, one of the dial window 15 and the rear cover 5 or the both thereof is or are made of resin as desired. In addition, the screw 62 may be made of nonmagnetic metal in place of resin.

Further, the wave timepiece 1 is further provided with a detection part of a time signal made of a circuit for detection of the received wave and a crystal oscillator or the like. The wave timepiece 1 retrieves the time information in the standard wave received by the antenna 40, controls the rotational driving of the motor 26 under the control of a time adjustment control part (not illustrated), and adjusts the time displayed by the pointer 18.

In the wave timepiece 1, the sensitivity of the antenna 40 can be enhanced, so that even in a location where the standard wave is comparatively weak and in a room of a building where the wave tends to be weak, the wave timepiece 1 can correct the displayed time by the pointer by receiving the standard wave more certainly.

Figure 3A:
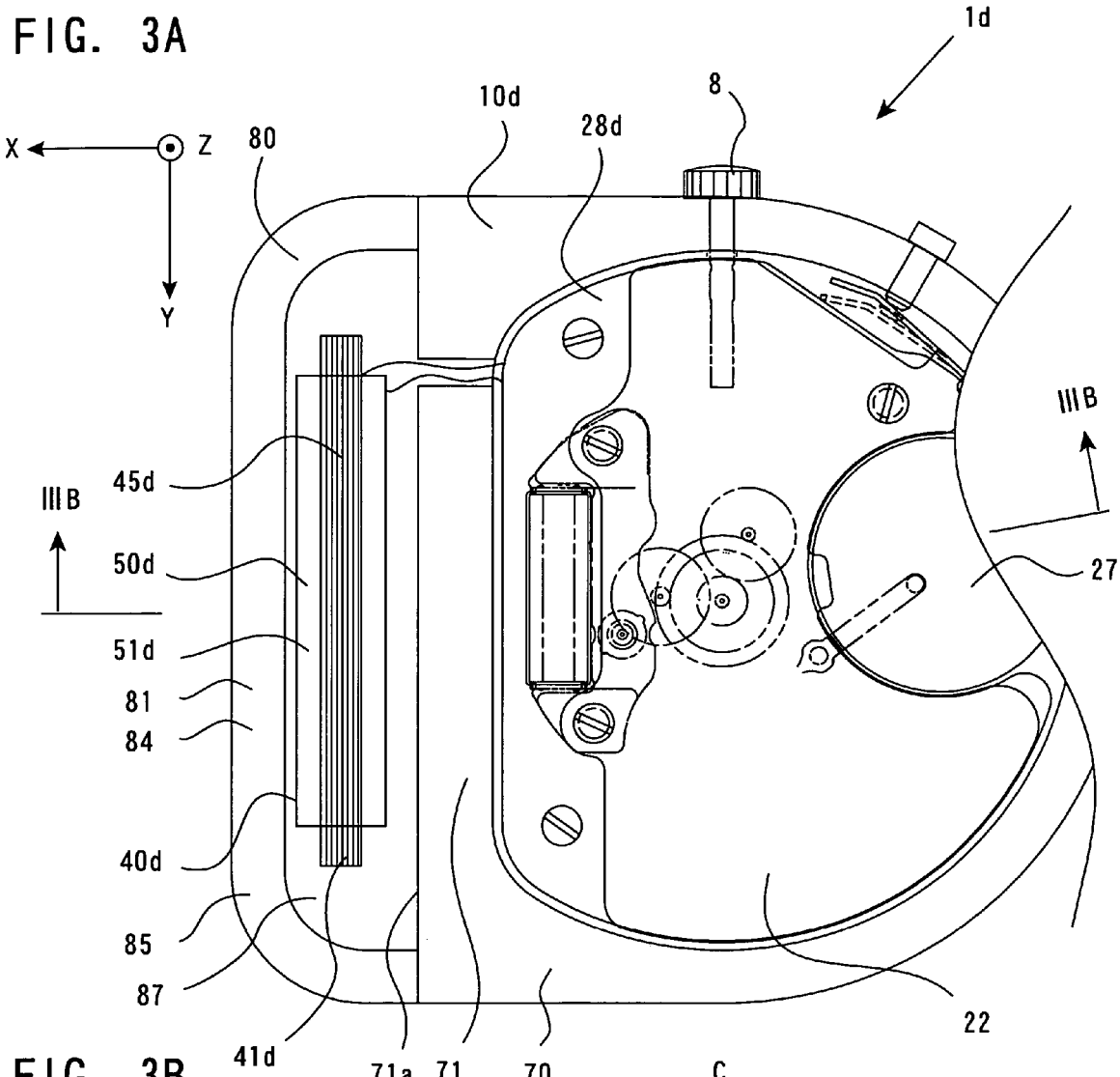
FIG. 3A is the similar plan explanatory view indicating the inside of a case with a rear cover omitted to FIG. 1A.

The antenna may be arranged outside the case in place of being arranged in the case. Such a wave timepiece 1*d* according to the second example is illustrated in FIG. 3. In a timepiece 1*d* of FIG. 3, the same member, elements, and regions as those of the timepiece 1 shown in FIG. 1 are given the same reference numerals and marks and the members, elements, and regions that are partially different are given a subscript d.

In this wave timepiece 1*d* according to the second example, a case 10*d* is shaped in a circle as a whole, but a portion 71 of a peripheral wall 70 is linearly shaped. The wave timepiece id has an antenna housing case 80 that is elongated and has approximately a rectangular shape at the outside of this linear side wall part 71.

The case 10*d* houses the same components as those of the case 10 therein except that the case 10*d* does not house the antenna therein.

Figure 3B:
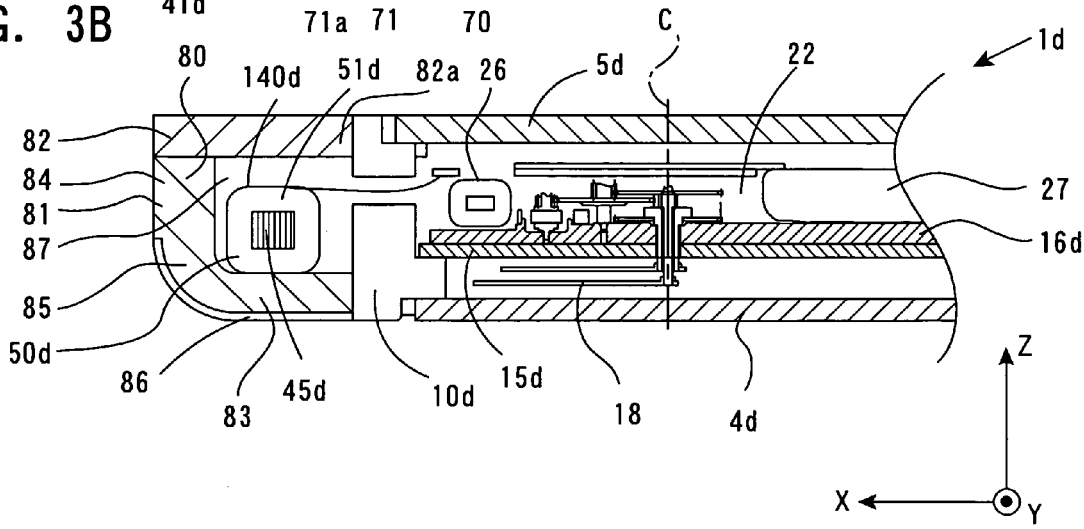
FIG. 3B is a sectional explanatory view taken on a line IIIB-IIIB of FIG. 3A.

As shown from FIG. 3B, the antenna housing case 80 has an outer wall part 81 whose section is shaped in a U-character, which is fixed to the case 10*d*. The outer wall part 81 is composed of a rear side wall part 82 made of resin and a front side wall part 85 made of resin. The rear side wall part 82 also may be made of metal. The rear side wall part 82 is fixed to an outer face 71*a* of the outer wall part 71 of the case 10*d* at one side 82*a* and is elongated on approximately the same face as the rear cover 5*d* at the rear side. The front side wall part 85 is composed of a front side wall portion 83 and an outside wall portion 84. The front side wall portion 83 is outwardly elongated at the side of a glass 4*d* and the outside wall portion 84 is curved from the front side wall portion 83, and is elongated continuously to the rear direction (+Z direction) to be continued to the rear side wall part 82. On the outer face of the front side wall part 85 of the outer wall part 81, a metal cover 86 is attached.

In an elongated chassis 87 whose section is a square and which formed by the antenna housing case 80 and the side wall 81 of the case 10*d*, a linear bar antenna 40*d* is housed. The antenna 40*d* has a linear magnetic core member 45*d* and a coil 50*d*. The magnetic core member 45*d* is composed of a lamination body in which many pieces of elongated foils 41*d* are laminated in the elongated direction (in this example, in the X-direction) of the main face (the X-Y plane) of the timepiece 1*d*. The foil 41*d* is elongated in a direction perpendicular to the elongated direction of the rear cover 5 and the dial window 15*d*. At the side wall part 71 of the case 10*d*, a through hole 73 is formed and a wire 51*d* of the coil 50*d* of the antenna 40*d* is elongated to the detection circuit in the case 10*d* passing through the hole 73.

As long as the antenna housing case 80 can house the antenna 40*d* therein and can be integrally attached to the case 10*d* of the main body, the structure and the shape of the wall thereof may be different from the illustrated structure and shape.

Also in the case of this wave timepiece 1*d*, since the foils 42*d* composing the magnetic core member 45*d* are laminated being elongated in the Z direction, occurrence of the eddy current due to the temporal variation of the leak of the magnet flux of the coil 50*d* of the antenna 40*d* can be minimized. Therefore, the detection sensitivity of the antenna 40 can be kept high. In the meantime, the foil is denoted by a reference numeral 41*d* in order to indicate that this foil is sufficiently longer than the coil 50*d*, however, in place of the foils of the same length, a combination of the foils having different lengths such that the shorter foils 42*d* are laminated at the side close to the metal case 10*d* or the like may be available.

In addition, these examples explain the case of the wrist watch, however, a table clock or a wall clock may be available.

What is claimed is:

1. In a wave timepiece having a case that has a thickness direction and a transverse direction that is transverse to the thickness direction and in which the thickness dimension of the case is less than the transverse dimension of the case: an antenna having a magnetic core member comprised of magnetic foils superposed and stacked one over another in the transverse direction and laminated together to form a laminated body; and a coil winding wound around the magnetic core member.

2. A wave timepiece according to claim 1; wherein the antenna is housed in the case between a dial window and a rear cover, and the laminated body is curved in an arc.

3. A wave timepiece according to claim 1; wherein the antenna is arranged in an antenna housing case provided at one side of the case.

4. A wave timepiece according to claim 1; wherein a dial window and a rear cover, both made of metal, are disposed in the case.

5. A wave timepiece according to claim 1; wherein the case has an inner circumferential curved face, the laminated body has a curved shape that conforms to the curvature of the inner circumferential curved face of the case, and the antenna is disposed in the case with the curved laminated body extending along and spaced apart from the inner circumferential curved face of the case.

6. A wave timepiece according to claim 5; wherein the magnetic foils of the curved laminated body that are closest to the inner circumferential curved face of the case are shorter in length than the magnetic foils of the laminated body that are farthest from the inner circumferential curved face of the case.

7. A wave timepiece according to claim 5; wherein the magnetic foils of the curved laminated body are comprised of a group of shorter foils and a group of longer foils, the longer foils having a longer length than that of the shorter foils, and the group of shorter foils being located closer to the inner circumferential curved face of the case than the group of longer foils.

8. A wave timepiece according to claim 7; wherein the coil winding is wound around the curved laminated body such that opposite end portions of the curved laminated body are left exposed, the exposed opposite end portions of the curved laminated body that do not have the coil winding wound thereon being connected to the case by antenna frames.

9. A wave timepiece according to claim 8; wherein each of the antenna frames has a passage in which one end portion of the curved laminated body extends, the passage having a constriction, and the group of longer foils extending in the passage past the constriction and the group of shorter foils extending in the passage and terminating short of the constriction.

10. A wave timepiece according to claim 9; wherein each antenna frame has a screw hole on an external part thereof in the region of the constriction, and a screw inserted into the screw hole for connecting the antenna frame to the case.

* * * * *